US007300736B2

(12) United States Patent
Fushimi et al.

(10) Patent No.: US 7,300,736 B2
(45) Date of Patent: Nov. 27, 2007

(54) TONER, AND DEVELOPER, IMAGE FORMING METHOD, IMAGE FORMING APPARATUS AND PROCESS CARTRIDGE USING THE TONER

(75) Inventors: Hiroyuki Fushimi, Numazu (JP); Osamu Uchinokura, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 285 days.

(21) Appl. No.: 10/854,703

(22) Filed: May 27, 2004

(65) Prior Publication Data

US 2005/0003289 A1 Jan. 6, 2005

(30) Foreign Application Priority Data

May 27, 2003 (JP) ..... 2003-149849

(51) Int. Cl.
*G03G 9/00* (2006.01)

(52) U.S. Cl. ..... 430/109.4; 430/108.3; 430/108.6; 430/109.1

(58) Field of Classification Search ..... 430/109.4, 430/108.3, 108.6
See application file for complete search history.

(56) References Cited

U.S. PATENT DOCUMENTS 4,762,763 A 8/1988 Nomura et al.
4,841,331 A 6/1989 Nakayama et al.
4,933,250 A 6/1990 Nakayama et al.
4,945,022 A 7/1990 Nakayama et al.
4,980,258 A 12/1990 Aoki et al.
5,061,588 A 10/1991 Fushimi et al.
5,418,103 A 5/1995 Muto et al.
5,604,071 A * 2/1997 Okado et al. ..... 430/108.6

(Continued)

FOREIGN PATENT DOCUMENTS

EP 1 003 081 5/2000

(Continued)

OTHER PUBLICATIONS

Chemical Abstracts citation for "Bontron E-84" (Reg # 42405-40-3) (Oct. 2006).*

(Continued)

*Primary Examiner*—Mark F. Huff
*Assistant Examiner*—Peter Vajda
(74) *Attorney, Agent, or Firm*—Oblon, Spivak, McClelland, Maier & Neustadt, P.C.

(57) ABSTRACT

A toner contains: (A) a binder resin; (B) a colorant; (C) a charge controlling agent; and (D) an additive. (A) contains: a polyester resin containing no tetrahydrofuran-insoluble component; and having components having a molecular weight not greater than $5\times10^2$ present in an amount of 4% or less by weight, a main peak present in a molecular weight range of from $3\times10^3$ to $9\times10^3$ as determined by gel permeation chromatography. (C) contains: a metal salt of salicylic acid or salicylic acid derivative. (D) contains: a hydrophobized silica having a primary particle diameter of from 0.01 to 0.03 μm; and a hydrophobized titanium oxide having a primary particle diameter of from 0.01 to 0.03 μm, a specific surface area of from 60 to 140 $m^2/g$, one or more water-soluble components in an amount of 0.2% or more by weight, a transmittance not less than 35% for light having a wavelength of 300 nm and a transmittance not less than 80% for light having a wavelength of 600 nm.

23 Claims, 2 Drawing Sheets

U.S. PATENT DOCUMENTS

| | | | | |
|---|---|---|---|---|
| 5,747,211 | A | 5/1998 | Hagi et al. | |
| 5,851,716 | A | 12/1998 | Kuramoto et al. | |
| 5,975,446 | A | 11/1999 | Yaguchi et al. | |
| 6,004,715 | A | 12/1999 | Suzuki et al. | |
| 6,014,532 | A | 1/2000 | Takeichi et al. | |
| 6,074,794 | A | 6/2000 | Fushimi et al. | |
| 6,103,441 | A | 8/2000 | Tomita et al. | |
| 6,118,964 | A | 9/2000 | Kojima et al. | |
| 6,125,257 | A | 9/2000 | Sekine et al. | |
| 6,168,894 | B1 | 1/2001 | Aoki et al. | |
| 6,360,068 | B1 | 3/2002 | Kinoshita et al. | |
| 6,416,914 | B1 | 7/2002 | Nakamura et al. | |
| 6,432,589 | B1 | 8/2002 | Uchinokura et al. | |
| 6,432,590 | B1 | 8/2002 | Ueda et al. | |
| 6,479,204 | B1 | 11/2002 | Uchinokura et al. | |
| 6,503,676 | B2 | 1/2003 | Yamashita et al. | |
| 6,641,969 | B2 | 11/2003 | Uchinokura et al. | |
| 6,733,939 | B2 | 5/2004 | Nanya et al. | |
| 2002/0132177 | A1 | 9/2002 | Sawada et al. | |
| 2003/0027074 | A1 | 2/2003 | Emoto et al. | |
| 2003/0162115 | A1* | 8/2003 | Uchinokura et al. | 430/109.4 |
| 2005/0003289 | A1 | 1/2005 | Fushimi et al. | |
| 2006/0067741 | A1* | 3/2006 | Azami | 399/267 |

FOREIGN PATENT DOCUMENTS

| | | |
|---|---|---|
| EP | 1 229 395 | 8/2002 |
| JP | 55-042752 | 3/1980 |
| JP | 56-128956 | 10/1981 |
| JP | 59-052255 | 3/1984 |
| JP | 60-112052 | 6/1985 |
| JP | 3-160688 | 7/1991 |
| JP | 3-232858 | 10/1991 |
| JP | 04-040467 | 2/1992 |
| JP | 07-043930 | 2/1995 |
| JP | 7-225489 | 8/1995 |
| JP | 2003-149849 | 5/2003 |

OTHER PUBLICATIONS

U.S. Appl. No. 11/080,542, filed Mar. 16, 2005, Uchinokura, et al.
U.S. Appl. No. 11/407,368, filed Apr. 20, 2006, Honda et al.
U.S. Appl. No. 10/305,191, filed Nov. 27, 2002, Uchinokura et al.
U.S. Appl. No. 10/114,056, filed Apr. 3, 2002, Fushimi et al.
U.S. Appl. No. 10/212,736, filed Aug. 7, 2002, Sugiura et al.
U.S. Appl. No. 10/176,578, filed Jun. 24, 2002, Yagi et al.
U.S. Appl. No. 10/153,627, filed May 24, 2002, Suzuki et al.
U.S. Appl. No. 09/712,927, filed Nov. 16, 2000, Unknown.
U.S. Appl. No. 10/193,216, filed Jul. 12, 2002, Uchinokura, et al.
U.S. Appl. No. 09/010,583, filed Jan. 22, 1998, Aoki et al.
U.S. Appl. No. 08/585,630, filed Jan. 16, 1996, Unknown.
U.S. Appl. No. 07/269.128. filed Nov. 9, 1988, Unknown.
U.S. Appl. No. 07/190,068, filed May 4, 1988, Asahina et al.
U.S. Appl. No. 07/109,217, filed Oct. 16, 1987, Unknown.
U.S. Appl. No. 11/685,872, filed Mar. 14, 2007, Uchinokura et al.
U.S. Appl. No. 11/558,736, filed Nov. 10, 2006, Osamu Uchinokura et al.
U.S. Appl. No. 11/685,969, filed Mar. 14, 2007, Uchinokura et al.

* cited by examiner

TONER, AND DEVELOPER, IMAGE FORMING METHOD, IMAGE FORMING APPARATUS AND PROCESS CARTRIDGE USING THE TONER

BACKGROUND OF THE INVENTION

1. Field of the Invention

The present invention relates to a toner and a developer using the toner for developing electrostatic images in electrophotography, electrostatic recording and electrostatic printing, and to an electrophotographic image forming method, an electrophotographic image forming apparatus and a process cartridge using the toner.

2. Discussion of the Background

Typically, a developer used in electrophotography, electrostatic recording and electrostatic printing and the like adheres to an image bearer such as a photoreceptor an electrostatic image is formed on in a developing process; transfers onto a transfer medium such as transfer sheets in a transfer process; and fixes on the transfer sheet in a fixing process. As the developer for developing the electrostatic image formed on the surface of the image bearer, a two-component developer including a carrier and a toner and a one-component developer (magnetic or nonmagnetic toner) not needing a carrier are known.

In two-component developing methods, toner particles adhere to the surface of the carrier and the developer deteriorates. In addition, a concentration of the toner in the developer decreases because only the toner is consumed, and a mixing ratio of the toner and the carrier has to be maintained at a specified ratio. Therefore, an image developer is comparatively large. To the contrary, in one-component developing methods, an image developer becomes smaller because of a sophisticated developing roller and the like.

Recently, office automation and colorization in offices are progressing, and opportunities in which not only copies of just letters but also a number of copies including graphs made by personal computers, images photographed by digital cameras, pictorial images, etc. are produced by printers for presentation increase. The produced image is mostly a complicated combination of solid images, line images and halftone images, and in accordance with this trend, a variety of market demands as well as demands for reliability of the image are increasing.

Conventionally, there is a magnetic one-component developing method using a magnetic toner and a non-magnetic one-component developing method using a non-magnetic toner in the electrophotographic process using the one-component developer. The magnetic one-component developing method is mostly used for compact printers recently, in which a developer bearer including a magnetic field generation means such as magnets bears a magnetic toner including a magnetic material such as a magnetite, and in which a layer-thickness regulation member forms a thin toner layer on the developer bearer for development. However, the magnetic material has a color, and mostly a black color and it is difficult to color the magnetic toner.

To the contrary, in the non-magnetic one-component developing method, a toner feed roller is pressed against a developer bearer to feed the toner onto the developer bearer which electrostatically bears the toner, and a layer-thickness regulation member forms a thin toner layer on the developer bearer for development. This method has an advantage of being usable for colorization because of not including a colored magnetic material, and is mostly used for compact full color printers recently, which are lightweight and low cost because of not using magnets in the developer bearers.

On the other hand, the two-component developing method uses a carrier as means of charging and transporting the toner, and the toner and carrier are transported to the developer bearer after they are sufficiently agitated and mixed in an image developer. Therefore, the toner can stably be charged and transported for a long time and the two-component developing method can easily be used for a high-speed image developer.

However, compared with the two-component developing method, the one-component developing method still has many points to be improved. In the one-component developing method, defective charge and transport of the toner due to long-time use and high-speed development tend to occur since the method does not have stable charge and transport means like the carrier. Namely, in the one-component developing method, a contact and friction charge time between the toner and friction charge members such as layer-thickness regulation members is so short that a toner having a low charge or a reverse charge tends to increase more than in the two-component developing method using a carrier.

Particularly in the non-magnetic one-component developing method in which ordinarily at least one toner transport member transports the toner (developer) and an electrostatic latent image formed on a latent-image bearer is developed by the transported toner, the thickness of the toner layer on the surface of the toner transport member has to be as thin as possible. This is same for the two-component developing method in which a carrier having quite a small diameter is used. In addition, particularly when a toner having high electric resistance is used as a one-component developer, the thickness of the toner layer has to be significantly thin because the toner has to be charged by the developing device. This is because when the toner layer is too thick, only the surface thereof is charged and the toner layer cannot be uniformly charged. Therefore, the toner needs to be charged quicker and to keep an appropriate charge quantity.

Accordingly, a charge controlling agent is conventionally included in a toner in order to stabilize the charge of the toner. The charge controlling agent controls and maintains the friction charge quantity of the toner. Specific examples of the negative charge controlling agents include monoazo dyes, salicylic acids, naphthoic acids, metallic salts and metal complex salts of dicarboxylic acids, diazo compounds, boric complex compounds, etc. Specific examples of the positive charge controlling agents include quaternary ammonium salt compounds, imidazole compounds, nigrosin, azine dyes, etc.

However, most of the charge controlling agents have colors and cannot be used for a color toner. In addition, some of the agents do not have good solubility with a binder resin and the agents on the surface of the toner, which largely affect the charge thereof, easily leave from the surface thereof. Therefore, the toner is unevenly charged, and toner filming over a developing sleeve and a photoreceptor tend to occur.

Accordingly, although images having good quality can be produced at the beginning, the image quality gradually changes and background fouling and image irregularity occur. Particularly, when the charge controlling agent is used for a toner for a full color copier producing continuous images while the toner is supplied to the copier, the charge quantity of the toner decreases and the color tone becomes noticeably different from that of the initial image. In addition, an image forming unit called as a process cartridge has to be changed quickly only after several thousand images are produced, which is a large environmental burden and gives troubles to users. Further, most of the units include heavy metals such as chrome and are becoming problems lately in view of safety.

Demands for printers are expanding lately, and down sizing, speeding up of printing and lowering cost of the printers are progressing. Accordingly, high reliability and long life of the printers are beginning to be required, and a toner capable of maintaining its properties for a long time is required as well. However, the above-mentioned resin charge controlling agents are unable to maintain the charge controllability, and contaminate a developing sleeve and a developer layer-thickness regulation members such as blades and rollers, resulting in lowering the chargeability of the toner and toner filming over a photoreceptor.

In addition, the developer is required to have a good chargeability because the development has to be performed by a small amount of a developer in a short time due to the downsizing and speeding up of printing. A variety of one-component and two-component developers are suggested, and a non-magnetic one-component developer is preferably used for a printer application because the printer can be smaller and lighter without using a carrier. In a developing method using the non-magnetic one-component developer, a toner is forcibly rubbed onto a developing roller or an amount of the toner thereon is regulated with a blade because of low toner feeding capability to the developing roller and toner retainability thereof. Consequently, toner filming over the developing roller tends to occur, resulting in shorter life of the developing roller, instability of charge quantity of the toner and poor development.

Further, a color toner for the non-magnetic one-component often includes a binder resin having a poor heat resistance and filming of the toner over the developing roller tends to occur.

Japanese Laid-Open Patent Publication No. 55-42752 discloses a salicylic acid or a metal complex thereof as a conventional charge controlling agent. However, a toner including the charge controlling agent does not have sufficient charge stability as desired and has poor resistance against environmental variation. Additives improve transportability, developability, transferability and preservability of the resultant toner besides controlling and maintaining a friction charge quantity thereof. Japanese Laid-Open Patent Publications Nos. 56-128956 and 59-52255 disclose a method of including a hydrophobic silica in a toner to improve these properties. However, the silica alone increases chargeability and transferability of the resultant toner too much, resulting in defective images such as scattered images and toner scattering.

Japanese Laid-Open Patent Publications Nos. 60-112052 and 4-40467 disclose a method of including titanium oxide or surface-treated titanium oxide with a coupling agent in a toner. However, the titanium oxide alone cannot impart a sufficient chargeability or a fluidity to the resultant toner. Further, the titanium oxide does not uniformly adhere to a toner because of its large particle diameter and secondary cohesion tendency, resulting in abnormal images.

Japanese Patent No. 3232858 discloses a surface-treated particulate titanium oxide. However, the surface-treated particulate titanium oxide alone cannot impart a sufficient charge quantity to the resultant toner yet although dispersibility of the surface-treated particulate titanium oxide is improved. Further, when the titanium oxide is used in combination with a silica, a charge quantity of the resultant toner adversely increases as time passes.

Further, Japanese Laid-Open Patent Publication No. 7-43930 and Japanese Patent No. 3160688 disclose a simultaneous use of a hydrophobic silica and hydrophobic titanium oxide. However, such a combination of additives having a high hydrophobicity increases a charge quantity of the resultant toner, resulting in defective transfer thereof.

As mentioned above, the conventional technologies have problems such as charge instability, instability against environmental variation, scattered images, toner scattering, insufficient fluidity, abnormal images due to the secondary cohesion, increase of charge quantity and defective transfer.

Because of these reasons, a need exists for a toner capable of stably controlling and keeping its charge quantity and chargeability; having less change due to environmental variation and good transportability, developability, transferability and preservability; and not adhering to a photoreceptor to produce abnormal images.

SUMMARY OF THE INVENTION

Accordingly, an object of the present invention is to provide a toner capable of stably controlling and keeping its charge quantity and chargeability; having less change due to environmental variation and good transportability, developability, transferability and preservability; and not adhering to a photoreceptor to produce abnormal images.

Another object of the present invention is to provide a developer including the toner; and an image forming method, an image forming apparatus and a process cartridge using the developer.

Briefly these objects and other objects of the present invention as hereinafter will become more readily apparent can be attained by a toner including:

(A) a binder resin;

(B) a colorant;

(C) a charge controlling agent; and (D) an additive;

wherein said binder resin (A) comprises:

a polyester resin containing no tetrahydrofuran-insoluble component; and having a molecular weight distribution wherein components having a molecular weight not greater than $5\times10^2$ are present in an amount of 4% or less by weight, and wherein a main peak is present in a molecular weight range of from $3\times10^3$ *to* $9\times10^3$ when the molecular weight distribution is determined by gel permeation chromatography;

wherein said charge controlling agent (C) comprises:

a metal salt of salicylic acid or salicylic acid derivative; and wherein said additive (D) comprises:

a hydrophobized silica having a primary particle diameter of from 0.01 to 0.03 μm; and a hydrophobized titanium oxide having a primary particle diameter of from 0.01 to 0.03 μm and a specific surface area of from 60 to 140 $m^2/g$, wherein the hydrophobized titanium oxide is prepared by surface-treating a particulate titanium oxide prepared by a wet process, wherein said hydrophobized titanium dioxide comprises one or more water-soluble components in an amount of 0.2% or more by weight, and has a transmittance not less than 35% for light having a wavelength of 300 nm and a transmittance not less than 80% for light having a wavelength of 600 nm;

a developer containing the toner, and an image forming method, image forming apparatus and process cartridge using the toner of the present invention.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
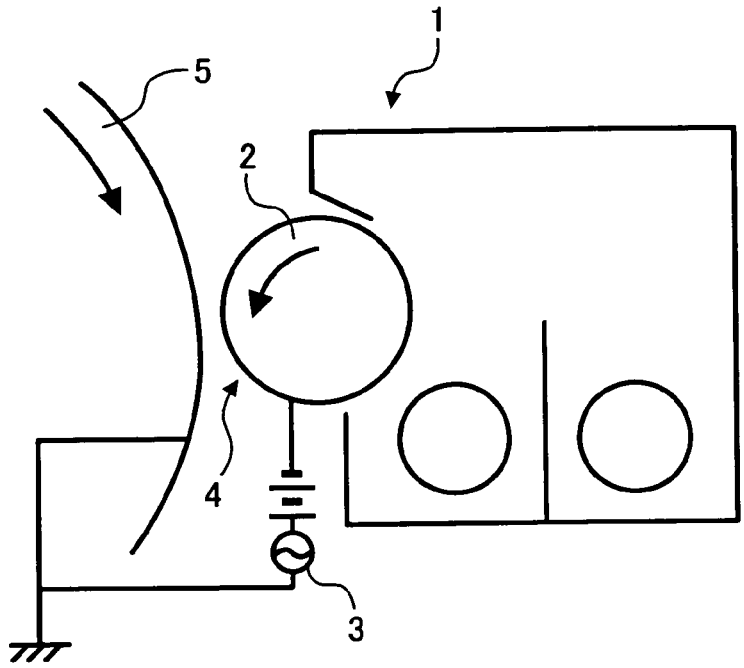
FIG. 1 is a schematic view illustrating an image forming apparatus developing an electrostatic latent image by applying an alternate electric field to the toner of the present invention.

Generally, the present invention provides a toner having a high charge quantity and a sharp charge quantity distribution; a good initial rise of charge and a good resistance against background fouling; not receiving an influence due to variation of temperature and humidity; preventing contamination of an image bearer (such as a developing roller and a developing sleeve) and a layer-thickness regulation member (such as a blade and a roller), and toner filming over a photoreceptor for long periods; and having good pulverizability and productivity.

The toner of the present invention includes a binder resin including at least a polyester resin; a charge controlling agent which is a salicylic acid or a metal salt compound of a salicylic acid derivative; a hydrophobic silica; and a hydrophobic titanium oxide.

The binder resin for use in the toner of the present invention is preferably a polyester resin, particularly in a color toner in view of the colorability and image strength. Since a color image has multiplied toner layers, a crack and defect of image occur due to the deficiency of the toner layer strength and appropriate image gloss is lost. This is because a polyester resin is used to maintain the appropriate gloss and the strength of the image.

The binder resin of the present invention is characterized by not including a tetrahydrofuran(THF)-insoluble component; including components having a molecular weight not greater than $5\times10^2$ in an amount of 4% by weight when measured by gel permeation chromatography (GPC); and having at least a main peak in a range of from $3\times10^3$ to $9\times10^3$ when measured by gel permeation chromatography. The transparency as well as glossiness of the resultant toner deteriorate when the binder resin includes a THF-insoluble component, and particularly a quality image cannot be produced on an OHP sheet. In a molecular weight distribution of the binder resin, a percentage by weight of components included therein having a molecular weight not greater than $5\times10^2$ is specified. In addition, when a ratio of a weight-average molecular weight (Mw) to a number-average molecular weight (Mn) of the binder resin is specified as $2\leqq Mw/Mn\leqq 10$, toner filming over the blade and roller is difficult to occur. When the components having a molecular weight not greater than $5\times10^2$ are greater than 4% by weight, the blade and sleeve are contaminated due to long-time use and toner filming tends to occur.

First, the polyester resin will be explained.

The polyester resin, i.e. the binder resin, is typically formed by an esterification reaction of polyalcohol and a polycarboxylic acid. Specific examples of alcohol monomers in monomers forming the polyester resin of the present invention include diol such as ethylene glycol, diethylene glycol, triethyleneglycol, 1,2-propyleneglycol, 1,3-propyleneglycol, 1,4-butadieneol, neo-pentyl glycol, 1,4-butenediol, 1,5-pentanediol and 1,6-hexanediol; adducts of a bisphenol A such as bisphenol A, hydrogenated bisphenol A and polyoxyproplylene modified bisphenol A with an alkylene oxide; and other dihydric alcohol; or sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxybenzene and other polyalcohol having three or more hydroxyl groups.

Among monomers forming a polyester resin, the adducts of a bisphenol A with an alkylene oxide are preferably used. The adducts of a bisphenol A with an alkylene oxide can form polyester having a high glass transition point because of the properties of the skeleton of bisphenol A, and the resultant toner has good copy blocking resistance and heat resistance. In addition, bilateral alkyl groups of the skeleton of bisphenol A work as a soft segment in a polymer, and the resultant toner has good colorability and strength when the toner image is fixed. Particularly, the adducts of a bisphenol A with an alkylene oxide having an ethylene or a propylene group are preferably used.

Including multifunctional monomers having three or more carboxylic groups, specific examples of polycarboxylic acid monomers in the monomers forming the polyester resin of the present invention include alkenyl or alkyl succinic acids such as maleic acids, fumaric acids, citraconic acids, itaconic acids, glutaconic acids, phthalic acids, isophthalic acids, terephthalic acids, cyclohexane dicarboxylic acids, succinic acids, adipic acids, sebacic acids, azelaic acids, malonic acids or n-dodecenylsuccinic acids and n-dodecylsuccinic acids; their anhydrides, alkyl ester and other dihydric carboxylic acids; and 1,2,4-benzenetricarboxylic acids, 2,5,7-naphthalenetricarboxylic acids, 1,2,4-naphthalenetricarboxylic acids, 1,2,4-butanetricarboxylic acids, 1,2,5-hexanetricarboxylic acids, 1,3-dicarboxyl-2-methyl-methylenecarboxypropane, tetra(methylenecarboxyl)methane, 1,2,7,8-octantetracarboxylic acids, empol trimer acids and their anhydrides, alkyl ester, alkenyl ester, aryl ester and other carboxylic acids having three or more carboxyl groups.

Specific examples of the above-mentioned alkyl groups, alkenyl groups or aryl esters include 1,2,4-benzenetricarboxylic acids, 1,2,4-trimethyl benzenecarboxylic acids, 1,2,4-triethyl benzenecarboxylic acids, 1,2,4-tri-n-octylbenzenecarboxylic acids, 1,2,4-tri-2-ethylhexyl benzenecarboxylate, 1,2,4-tribenzyl benzenecarboxylate, 1,2,4-tris(4-isopropylbenzyl)benzenetricarboxylate, etc.

A method of forming the polyester resin of the present invention is not limited, and the esterification reaction can be performed by known methods. An ester exchange reaction can be performed by known methods, and known ester exchange catalysts such as magnesium acetate, zinc acetate, manganese acetate, calcium acetate, tin acetate, lead acetate and titanium tetrabutoxide can be used. A polycondensation reaction can be performed by known methods, and known polymerization catalysts such as antimony trioxide and germanium dioxide can be used.

The molecular weight distribution of the binder resin for use in the toner of the of the present invention is measured as follows:

(1) a column is stabilized in a heat chamber having a temperature of 40° C.;

(2) THF is put into the column at a speed of 1 ml/minas a solvent;

(3) 200 μl of the THF liquid-solution sample including the mother toner having a concentration of from 0.05 to 0.6% by weight, from which THF-insoluble components are removed by a filter having 0.45 μm screen mesh is put into the column; and (4) the molecular weight distribution of the sample is determined by using a calibration curve which is previously prepared using several polystyrene standard samples having a single distribution peak, and which shows the relationship between a count number and the molecular weight.

As the standard polystyrene samples for preparing the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 kinds of the standard polystyrene samples. In addition, an RI (refraction index) detector is used as the detector.

In addition, whether the binder resin includes THF-insoluble components is determined when the THF liquid solution sample is formed to measure the molecular weight distribution. Namely, when the THF liquid-solution is discharged from a syringe with a 0.45 μm filter at its end, it is determined that there is no THF-insoluble component if the filter is not clogged.

The binder resin for use in the toner of the present invention preferably has an endothermic peak in a temperature range of from 60 to 70° C. when measured by a differential scanning calorimeter. Preservability of the resultant toner deteriorates when the peak is less than 60° C., and the toner is solidified in a cartridge and a hopper. Productivity of the toner deteriorates when greater than 70° C., such as deterioration of an amount of toner constituents fed when pulverized. The endothermic peak in the present invention is measured by Rigaku THERMOFLEX TG 8110 manufactured by RIGAKU Corp. at a programming rate of 10° C./min, and the maximum peak of an endothermic curve is determined as the endothermic peak.

The binder resin for use in the present invention preferably has a weight-average molecular weight (Mw) and a number-average molecular weight (Mn) satisfying the following relationship:

$$2 \leqq Mw/Mn \leqq 10$$

The resultant toner does not have sufficient gloss and quality images cannot be produced when Mw/Mn is greater than 10. When Mw/Mn is less than 2, the productivity of pulverizing process for preparing a toner deteriorates and a blade and a sleeve of an image developer are contaminated due to long-time use and toner filming tends to occur.

The binder resin of the present invention preferably has an acid value not greater than 10 KOH mg/g in consideration of an interaction between a charge controlling agent and an additive mentioned later.

It is known that the polyester resin has a proportional relationship between its chargeability and acid value, and that the greater the acid value, the greater the negative chargeability of the resin. At the same time, the acid value of the resin affects the charge stability against an environment of the resultant toner. Namely, when the acid value is high, the charge quantity of the toner increases under a low temperature and low humidity and decreases under a high temperature and high humidity. A variation of the charge stability of the toner against the environment largely causes a variation of background fouling, image density and color reproducibility of the resultant toner, and therefore high quality images are difficult to keep producing. When the acid value is greater than 10 KOH mg/g, the charge quantity of the toner increases and the environmental resistance thereof deteriorates.

Chargeabilities and resistances of a charge controlling agent, a hydrophobic silica and a hydrophobic titanium oxide mentioned later control a resistance of the resultant toner particles. Therefore, when the polyester resin has an acid value greater than 10 KOH mg/g, charge controllabilities of the charge controlling agent, hydrophobic silica and hydrophobic titanium oxide are impaired. The polyester resin for use in the present invention preferably has an acid value not greater than 10 KOH mg/g, and more preferably not greater than 5 KOH mg/g.

Further, the binder resin for use in the present invention preferably has an apparent viscosity of $10^4$ Pa·S at a temperature of from 95 to 120° C. when measured by a flow tester. When the apparent viscosity is $10^4$ Pa·S at less than 95° C., hot offset resistance when the a toner image is fixed deteriorates. When greater than 120° C., the toner does not have sufficient gloss.

The temperature at which the apparent viscosity becomes $10^4$ Pa·S is measured by a flow tester CFT-500 manufactured by Shimadzu Corp. under the following conditions:

pressure: 10 kg/cm$^2$;

orifice size: 1 mm×1 mm; and programming rate: 5° C./min

Next, a charge controlling agent for use in the toner of the present invention will be explained.

The charge controlling agent for use in the toner of the present invention is a salicylic acid or a metal salt compound of a salicylic acid derivative having the following formula (1):

(1)

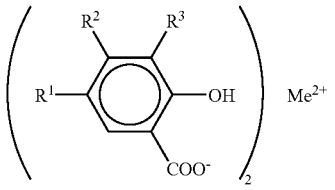

wherein $R^1$, $R^2$ and $R^3$ independently represent a hydrogen atom, an alkyl group having 1 to 10 carbon atoms or an allyl group, preferably a hydrogen atom, an alkyl group having 1 to 6 carbon atoms or an allyl group; and Me represents a metal selected from Zn, Ni, Co, Pb and Cr, and particularly Zn is preferably used.

The salicylic acid or metallic salt compound of a salicylic acid derivative having the above-mentioned formula can easily be formed by a method mentioned in CLARK, J. L. Kao, H(1948) J. Amer. Chem. Soc. 70, 2151. For example, 2 moles of a sodium salt salicylate (including a sodium salt of a salicylic acid derivative) and 1 mole of zinc chloride are mixed in a solvent, and the mixture is heated and stirred to form a zinc salt. The metallic salt is a white crystalline and does not color when dispersed in the toner. Other metallic salts besides the zinc salt can be formed in accordance with the above-mentioned method.

The salicylic acid or metal salt compound of a salicylic acid derivative can be used alone or in combination. In addition, other charge controlling agents can be used together with the salicylic acid or metal salt compound of a salicylic acid derivative. Specific examples of the other charge controlling agents include known charge controlling agents such as nigrosin dyes, triphenylmethane dyes, metal complex dyes including chromium, chelate compounds of molybdic acid, Rhodamine dyes, alkoxyamines, quaternary ammonium salts, fluorine-modified quaternary ammonium salts, alkylamide and phosphor or compounds including phosphor. In particular, transparent or white charge controlling agents are used for a color toner because of not impairing the color tone. Specific examples of the transparent or white charge controlling agents include organic boron salts, quaternary ammonium salts including a fluorine atom and calix allene compounds.

A dispersion of a charge controlling agent in a binder resin is a large factor to determine a chargeability of the resultant toner. In the present invention, a toner having a good chargeability and a charge rising capability can be obtained by a combination of a specific binder resin and a specific resin charge controlling agent. However, it is apparent as mentioned above, that dispersibility (solubility) of the resin charge controlling agent in the binder resin affects the chargeability of the resultant toner.

In the present invention, the binder resin preferably has a main peak in a molecular weight range of from $3\times10^3$ to $9\times10^3$, an apparent viscosity of $10^4$ Pa·S when measured by a flow tester at a temperature of from 95 to 120° C. and an acid value not greater than 10 KOH mg/g. When the binder resin having these properties and a charge controlling agent formed from the salicylic acid or metallic salt compound of a salicylic acid derivative are kneaded upon application of heat, the charge controlling agent is moderately dispersed in the binder resin to form a tone having a good charge rising capability and less deterioration with age and environment.

When the binder resin has a main peak in a molecular weight range less than $3\times10^3$ or an apparent viscosity of $10^4$ Pa·S when measured by a flow tester at lower than 95° C., the binder resin has a low molecular weight and the charge controlling agent becomes difficult to disperse, and therefore the resultant toner does not have a sufficient charge quantity. When the binder resin has a main peak in a molecular weight range greater than $9\times10^3$ or an apparent viscosity of $10^4$ Pa·S when measured by a flow tester at higher than 120° C., the charge controlling agent is finely dispersed in the binder resin too much and the resultant toner has a low charge quantity. A combination of the binder resin having an acid value greater than 10 KOH mg/g and the charge controlling agent continues increasing a charge quantity of the resultant toner, and the charge quantity is not saturated therein. Therefore, the resultant toner comes not to have charge stability with age.

A content of the charge controlling agent for use in the toner of the present invention is preferably from 0.1 to 10%, and more preferably from 0.5 to 5% by weight based on total weight of the toner particle. When less than 0.1% by weight, the resultant toner does not have a sufficient charge quantity, and therefore background fouling and scattered images tend to occur. When greater than 10% by weight, the charge controlling agent is not dispersed well and a charge quantity distribution of the resultant toner becomes wide, and therefore background fouling and toner scattering tend to occur.

Additives for use in the toner of the present invention are a hydrophobized silica having a primary particle diameter of from 0.01 to 0.03 μm and a hydrophobized titanium oxide having a primary particle diameter of from 0.01 to 0.03 μm and a specific surface area of from 60 to 140 $m^2/g$. When these additives are used together with the above-mentioned polyester resin and charge controlling agent, the resultant toner has a stable chargeability.

Namely, when the hydrophobized silica having a primary particle diameter of from 0.01 to 0.03 μm is adhered to a surface of a mother toner, the resultant toner has a sufficient fluidity and a chargeability to transfer well on a developing roller and therefrom to a photoreceptor. The hydrophobized silica is preferably included in the mother toner in an amount not less than 2.1 parts by weight per 100 parts by weight of the mother toner to uniform a thin layer of the toner on the developing roller, largely improve unevenness of the thin layer and prevent production of white stripes due to fusion bond of the toner on a coating blade of a developer stirred by the developing roller for long periods.

When the silica is included in the mother toner in an amount less than 2.1 parts by weight, the resultant toner does not have sufficient fluidity, and therefore occasionally a required amount of the toner is not provided to the developing roller and the resultant toner does not have a required charge quantity. In addition, the thin layer of the toner on the developing roller becomes uneven, and therefore occasionally development and image production with uniform toner cannot be made and white stripes due to fusion bond of the toner on a coating blade of a stirred developer are produced.

When the hydrophobized titanium oxide having a primary particle diameter of from 0.01 to 0.03 μm and a specific surface area of from 60 to 140 $m^2/g$ is adhered to a surface of a mother toner, the resultant toner has a stable chargeability, and particularly has an improved charge rising capability and charge-up of the resultant toner can be prevented. The hydrophobized titanium oxide is preferably included in the mother toner in an amount of from 0.4 to 1.0 parts by weight per 100 parts by weight of the mother toner. When the hydrophobized titanium oxide is included therein in an amount less than 0.4 parts by weight, the resultant toner has too high a chargeability to develop. When the hydrophobized titanium oxide is included therein in an amount greater than 1.0 parts by weight, the resultant toner too low a chargeability, resulting in toner scattering from the developing roller and background fouling.

The above-mentioned mother toner means a particulate material on the way of preparation, including at least a binder resin, a colorant and a charge controlling agent besides the additives.

The hydrophobized titanium oxide is a surface-treated particulate titanium oxide prepared by a wet process; includes water-soluble components in an amount of 0.2% by weight; and has a transmittance not less than 35% for light having a wavelength of 300 nm and a transmittance not less than 80% for light having a wavelength of 600 nm in a UV light extinction. A titanium oxide is typically formed by a wet method. Specific examples of an ore including titanium include rutile, anatase, brookite and ilmenite. A sulfuric acid method of adding a concentrated sulfuric acid to the ore to dissolve the core and a choleric method of red-heat dehydrating the ore with a carbon material and exposing the dehydrated core to a chlorine gas are available.

Either of the methods purifies titanium hydroxide $Ti(OH)_2$, and precipitates a $TiO_2$ crystal by a hydrolysis finally.

The $TiO_2$ includes water-soluble components which are catalysts, alkaline metal ions and acid components included in a processing agent, such as $PO_4^{2-}$, $SO_4^{2-}$, $Cl^-$, $Na^+$, $Mg^{2+}$ and $Li^+$. These water-soluble components are known to affect chargeability and resistance of the resultant toner, and it is said that a high charge quantity thereof can be maintained when a content of the water-soluble components is controlled to be less than 0.2% by weight.

However, in the present invention, it is a resistance and a particle diameter distribution of the titanium oxide that matter more than a higher chargeability thereof.

Namely, titanium oxide including water-soluble components in an amount not less than 0.2% by weight prevents the charge quantity of the resultant toner from increasing as time passes, which is further improved when combined with the silica. An amount of the water-soluble components was measured in accordance with JIS K5116-1973.

A surface treatment with a coupling agent, etc. is typically performed on the titanium oxide to enhance its function. However, the water-soluble components included in the titanium oxide affect a resistance and a chargeability of the resultant surface-treated titanium oxide as well as the surface treatment. Further, a secondary cohesion of the titanium oxide changes depending on a dispersion of the surface treatment agent. Typically, a highly uniform treatment is performed on the titanium oxide to maintain a primary particle diameter thereof. However, a charge quantity of the resultant toner increases as time passes and adheres to a photoreceptor with the titanium oxide alone. Therefore, in the present invention, a dispersion of the titanium oxide is increased and the resistance thereof is decreased. As an index representing a particle diameter of the titanium oxide, a transmittance thereof in a specific solvent is used.

In the present invention, the titanium oxide preferably has a transmittance not less than 35% for light having a wavelength of 300 nm and a transmittance not less than 80% for light having a wavelength of 600 nm. The surface-treated titanium oxide including water-soluble components in an amount not less than 0.2% by weight to decrease a resistance thereof needs to have a transmittance not less than 35% for light having a wavelength of 300 nm. The lower the resistance, the smaller the particle diameter of the titanium oxide to well disperse on a surface of the toner. The titanium oxide needs to have a transmittance not less than 80% for light having a wavelength of 600 nm. When less than 80%, a surface of the titanium oxide is not uniformly treated with a coupling agent and the titanium oxide aggregates.

The transmittance is measured as follows.

Precisely weighed 20 g of a reagent (polyoxyethyleneoctylphenylether) are put in a beaker, ion-exchanged water is added thereto to have a solid content concentration of 1% by weight to prepare an aqueous solution. The aqueous solution is dispersed by a supersonic vibrator W-113 ® from HONDA ELECTRONICS CO., LTD., and further stirred by a magnetic stirrer to prepare a measurement solvent. Next, 25 mg of a sample (titanium oxide) are put in a conical flask having a capacity of 300 ml, and 250 g of the measurement solvent are added thereto and stirred by a magnetic stirrer for 5 min to prepare a mixture. Then, the mixture is dispersed by a supersonic vibrator for 5 min to prepare a dispersion liquid. From time to time, the flask is shaken by hand to disperse an agglomerate. Immediately after dispersed, 2 g of the dispersion liquid are put in a sample bottle having a capacity of 30 ml, and 18 g of ion-exchanged water are added thereto to prepare a mixed solvent. The mixed solvent is quietly shaken by hand so as not to be foamed and put on a glass cell having a path width of 1 cm, which is set in a UV apparatus (a spectrophotometer UV-3100 ® from Shimadzu Corp.) to measure a light absorbance of the titanium oxide in a range of wavelength of from 300 to 700 nm.

The toner of the present invention includes the above-mentioned binder resin, charge controlling agent and additive having optimized properties.

Any known dyes and pigments can be used as the colorant for use in the toner of the present invention. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, Benzimidazolone Yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Carmine 6B, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These colorants are used alone or in combination.

The toner preferably includes the colorant in an amount of from 0.1 to 50 parts by weight per 100 parts by weight of the binder resin included in the toner.

The toner of the present invention may include other additives, e.g., teflon; fluoropolymers; low-molecular-weight polyolefin; metal oxides such as titanium oxide, aluminium oxide, tin oxide and stibium oxide; electroconductivity imparting agents such as carbon black and tin oxide; magnetic materials; their surface-treated materials, etc. These additives can be used alone or in combination, and a content thereof is from 0.1 to 10 parts by weight per 100 parts by weight of the toner.

The toner of the present invention may be a magnetic toner including a magnetic material. Specific examples of the magnetic materials include iron oxides such as magnetite, ferrite and hematite; metals such as Fe, Co and Ni; and alloyed metals or mixtures of these metals and Al, Co, Cu, Pb, Mg, Sn, Zn, Sb, Be, Bi, Ca, Cd, Mn, Se, Ti, W, V, etc. These magnetic materials preferably have a volume average particle diameter of from about 0.1 to 2 μm, and a content thereof is from 5 to 150 parts by weight per 100 parts by weight of the binder resin.

The toner of the present invention may be used together with a carrier as a two-component developer. Any conventional carriers, e.g., iron powders, ferrite, magnetite, glass beads, etc. can be used.

In addition, these carriers may be coated with a resin. Known resins such as polyfluorocarbon, polyvinyl chloride, polyvinylidene chloride, phenol resins, polyvinyl acetal, acrylic resins and silicone resins can be used, and a silicone coated carrier is preferably used because the resultant developer has a long life.

Further, an electroconductive powder may optionally be included in the coated resin. As the electroconductive powder, metallic powders, carbon black, titanium oxide tin oxide, zinc oxide, etc. can be used. The electroconductive powder preferably has an average particle diameter not greater than 1 μm. When the average particle diameter is greater than 1 μm, it becomes difficult to control an electric resistance of the resultant toner. A mixing ratio of the toner in a two-component developer is typically from 0.5 to 20 parts by weight per 100 parts by weight of the carrier.

Any known methods may be used for preparing the toner of the present invention, i.e., methods including a process of mechanically mixing toner constituents including at least a binder resin, a charge controlling agent and a colorant to prepare a mixture; a process of kneading the mixture upon application of heat; a process of pulverizing the mixture; and a process of classifying the pulverized mixture, can be used. In addition, a method of reusing a powder besides a specified product in the mechanical mixing and kneading process, which are produced in the pulverizing or classifying process, is included as well.

The powder besides the specified product (by-product) means fine and coarse particles produced in the pulverizing or classifying process after the kneading process, the particle diameters of which are out of a desired diameter. From 1 to 20 parts by weight of such a by-product are preferably mixed with 100 parts by weight of the main material in the mixing or kneading process.

A mechanical mixing process of mixing toner constituents including at least a binder resin, a colorant and a charge controlling agent; and mechanical mixing process of mixing toner constituents including the binder resin, colorant, charge controlling agent and a by-product can be performed by a conventional mixer having a rotating blade under a conventional condition, and are not particularly limited.

In the kneading process following the mixing process, the mixture is contained in a kneader and then kneaded upon application of heat. Suitable kneaders include the kneaders include single-axis or double-axis continuous kneaders and batch kneaders such as roll mills. Specific examples of the kneaders include KTK double-axis extruders manufactured by Kobe Steel, Ltd., TEM extruders manufactured by Toshiba Machine Co., Ltd., double-axis extruders manufactured by KCK Co., Ltd., PCM double-axis extruders manufactured by Ikegai Corp., and KO-KNEADER manufactured by Buss AG.

In the kneading process, it is important to control the kneading conditions so as not to cut molecular chains of the binder resin in the toner. Specifically, when the mixture is kneaded at a temperature too lower than a softening point of the binder resin, the molecular chains of the binder resin tend to cut. When the kneading temperature is too high, the mixture cannot be fully dispersed.

In the pulverizing process, it is preferable that the kneaded mixture is at first crushed to prepare coarse particles (crushing step) and then the coarse particles are pulverized to prepare fine particles (pulverizing step). In the pulverizing step, a method of crashing the coarse particles against a collision plate by jet air or a method of passing the coarse particles through a narrow gap between a mechanically rotating rotor and a stator is preferably used. After the pulverizing process, the powder is air-classified using centrifugal force to prepare a mother toner having a predetermined average particle diameter of, e.g., from 5 to 20 μm.

Then the mother toner may be mixed with the external additives, i.e., inorganic particulate materials of the present invention, such as fine powders of hydrophobic silica and titanium oxide to improve the fluidity, developability and transferability.

Suitable mixers include known mixers for mixing powders, which preferably have jackets to control the inside temperature thereof. To change a history of stress on the external additive, the external additive may be added to the toner constituents on the way of the mixing process or gradually added thereto. Of course, by changing rotating number of the blade of the mixer used, mixing time, mixing temperature, etc., the stress can also be changed. In addition, a mixing method of applying a relatively high stress at first and then a relatively low stress to the external additive, or vice versa, can also be used. Specific examples of the mixers include V-form mixers, locking mixers, Loedge Mixers, Nauter Mixers, Henschel Mixers, etc.

An image forming method and an image forming apparatus using the dry one-component and two-component developer of the present invention can be used for any conventional image forming methods and apparatuses basically having a process of forming a latent image on a latent image bearer; a process of developing the latent image with a developer on a developer bearer to form a toner image; a process of transferring the toner image onto a transfer sheet; and a process of fixing the toner image on the transfer sheet upon application of heat. In the above-mentioned process of developing the latent image on the latent image bearer in the image forming method of the present invention, an alternate electric field is applied to the latent image bearer to produce high-definition images without surface roughness. In an image developer 1 of an embodiment of the image forming apparatus of the present invention in FIG. 1, a vibration bias voltage formed of a DC voltage overlapped with an AC voltage is applied to a developing sleeve 2 from an electric source 3 as a developing bias. Potentials of a background and an image portions are located between a maximum value and a minimum value of the vibration bias potential. Thus, an alternate electric filed alternating its direction is formed on a developing portion 4. In the alternate electric filed, a toner (one-component developer) or a toner and a carrier (two-component developer) vibrate hard, and the toner escapes from an electrostatic binding force to the developing sleeve 2 or the developing sleeve 2 and carrier. Then, the toner soars to a photoreceptor drum 5 and adheres to a latent image thereon.

A difference between maximum and minimum values of the vibration bias voltage (a voltage between peaks) is preferably from 0.5 to 5 KV, and a frequency is preferably from 1 to 10 KHz. Waveforms of the vibration bias voltage include a rectangular wave, a sine wave, a triangular wave and the like waves. The DC voltage is a value between the potentials of the background and image as mentioned above, and the value is preferably closer to the potential of the background than to that of the image to prevent foggy images in a potential area of the background.

When the vibration bias voltage has a rectangular waveform, a duty ratio is preferably not greater than 50%. The duty ratio is a time ratio while the toner goes for the photoreceptor in a cycle of the vibration bias. Thus, a difference between a peak value of the toner going for the photoreceptor and an average time of the bias can be large to further activate the toner movement. Therefore, the toner faithfully adheres to a potential distribution on a surface of a latent image to decrease surface roughness and improve image resolution. When a two-component developer is used, a carrier having a reverse polarity to that of the toner can reduce the difference between a peak value of the toner going for the photoreceptor and an average time of the bias. Therefore, the carrier movement can be calmed and a probability of the carrier adhering to a background of the latent image can largely be reduced.

Figure 2:
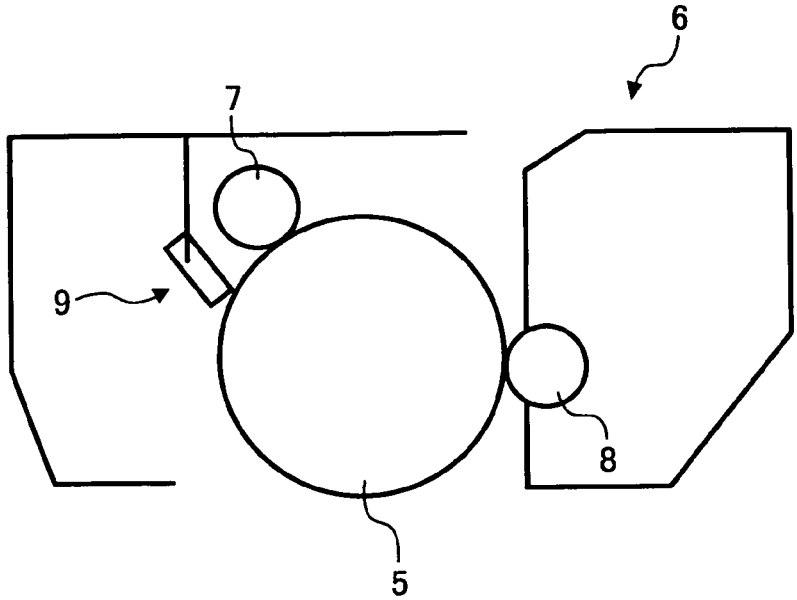
FIG. 2 is a schematic view illustrating a process cartridge using the toner of the present invention.

In the image forming apparatus of the present invention, a process cartridge including an image developer and at least a member selected from the group consisting of photoreceptors, chargers and cleaners, which is detachable with the image forming apparatus may be used. FIG. 2 is a schematic view illustrating a process cartridge having a developing portion using the toner of the present invention, including an image developer 8 and at least a member selected from the group consisting of photoreceptors 5, chargers 7 and cleaners 9, which is detachably installed in an image forming apparatus such as copiers and printers.

In the fixing process in the image forming method of the present invention, the fixer may be so-called a surf fixer having a heater including a heating element, a film contacting the heater and a pressurizer pressing the film against the heater, wherein a recording material an unfixed image is formed on is passed between the film and pressurizer to fix the unfixed image on the recording material.

Figure 3:
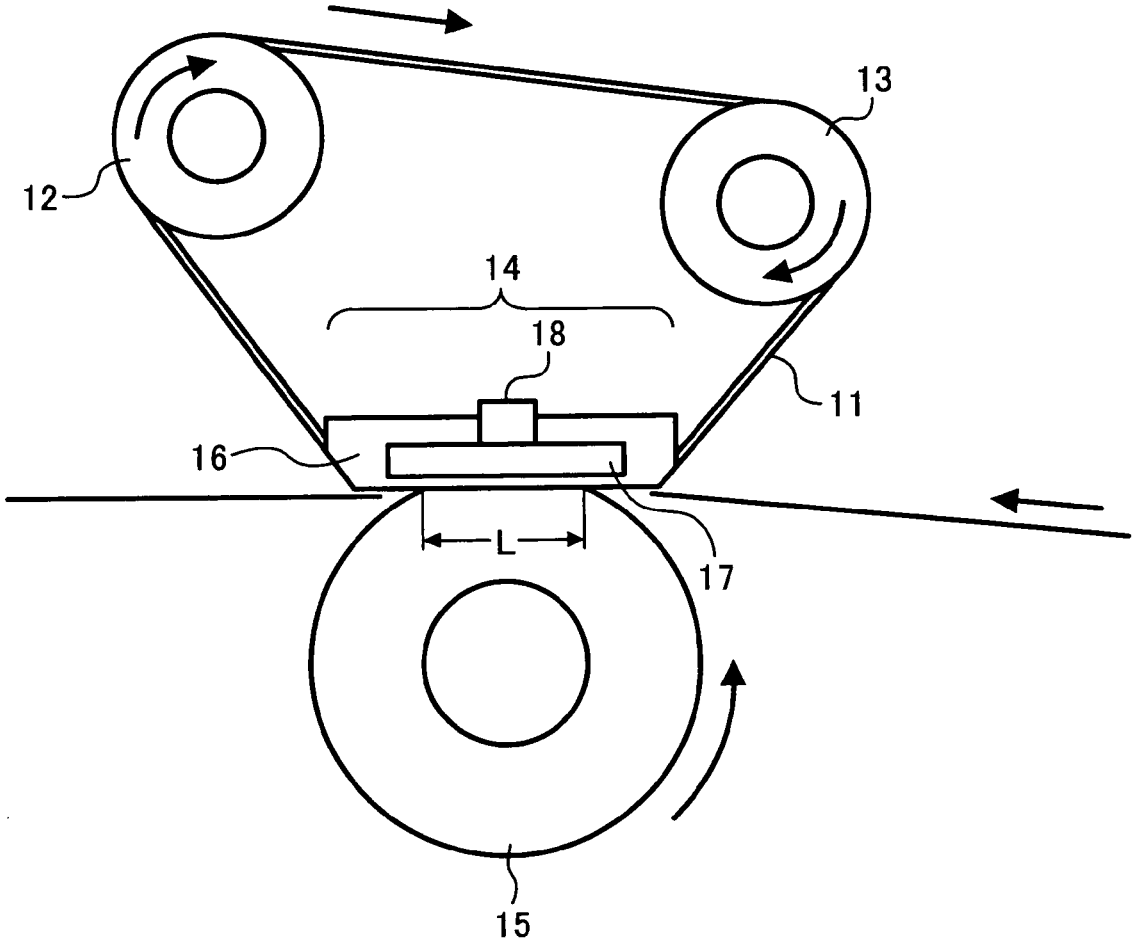
FIG. 3 is a schematic view illustrating a cross section of a surf fixer using the toner of the present invention.

The surf fixer rotates a fixing film to fix an image as shown in FIG. 3. The fixing film 11 is a heat resistant film having the shape of an endless belt, which is suspended and strained among a driving roller 12, a driven roller 13 and a heater 14 located therebetween underneath.

The driven roller 13 is a tension roller as well, and the fixing film 11 rotates clockwise according to a clockwise rotation of the driving roller 13. The rotational speed of the fixing film 11 is equivalent to that of the recording material at a fixing nip area L where a pressure roller 15 and the fixing film 11 contact each other. The pressure roller has a rubber elastic layer having good releasability such as silicone rubbers, and rotates counterclockwise while contacting the fixing nip area L at a total pressure of from 4 to 10 kg.

The fixing film preferably has a good heat resistance, releasability and durability, and has a total thickness not greater than 100 μm, and preferably not greater than 40 μm. Specific examples of the fixing film include films formed of a single-layered or a multi-layered film of heat resistant resins such as polyimide, polyetherimide, polyethersulfide and PFA having a thickness of 20 μm, on the surface contacting an image of which a release layer including an electroconductive material such as PTFE and PFA and having a thickness of 10 μm, or an elastic layer including a fluorocarbon rubber or a silicone rubber is coated.

In FIG. 3, the heater 14 is formed of a flat substrate 16 and a fixing heater 17, and the flat substrate 16 is formed of a material having a high heat conductivity and a high electric resistance such as alumina. The fixing heater 17 formed of a resistance heater is located on a surface of the heater contacting the fixing film 11 in the longitudinal direction of the heater. An electric resistant material such as Ag/Pd and $Ta_2N$ is linearly or zonally coated on the fixing heater by a screen printing method, etc. Both ends of the fixing heater have electrodes (not shown) and the resistant heater generates a heat when electricity passes though the electrodes. Further, a fixing temperature sensor 18 formed of a thermistor is located on the other side of the substrate opposite to the side on which the fixing heater 17 is located. Temperature information of the substrate detected by the fixing temperature sensor 18 is transmitted to a controller (not shown) controlling an electric energy provided to the fixing heater 17 to make the heater have a predetermined temperature.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Examples of Binder Resins

Synthesis Example 1

The following materials were mixed in a four-opening separable flask with a stirrer, a thermometer, a nitrogen lead-in opening and a falling condenser with an esterified catalyst.

| | |
|---|---|
| Polyoxypropylene(2,2)-2,2-bis (4-hydroxyphenyl)propane | 740 g |
| Polyoxyethylene(2,2)-2,2-bis (4-hydroxyphenyl)propane | 300 g |
| Dimethylterephthalate | 466 g |
| Isododecenylsuccinic anhydride | 80 g |
| n-butyl 1,2,4-benzenetricarboxylate | 114 g |

The mixture was stirred while heated up to 210° C. at an atmospheric pressure and depressurized at 210° C. Thus, a polyester resin A having a compound having a molecular weight not greater than $5\times10^2$ in an amount of 3.5%; a molecular weight peak of $7.5\times10^3$; a glass transition temperature of 62° C.; a ratio (Mw/Mn) of 5.1; an acid value of 2.3 KOH mg/g; and a temperature at which the resin has an apparent viscosity of $10^3$ Pa·s when measured by a flow tester of 112° C. was prepared. The polyester resin A did not include THF-insoluble components.

Synthesis Example 2

The procedure for preparation of the polyester resin A was repeated except for using the following materials and formulation to prepare a polyester resin B:

| | |
|---|---|
| Polyoxypropylene(2,2)-2,2-bis (4-hydroxyphenyl)propane | 725 g |
| Polyoxyethylene(2,2)-2,2-bis (4-hydroxyphenyl)propane | 165 g |
| Terephthalic acid | 500 g |
| Isododecenylsuccinic anhydride | 130 g |
| 1,2,4-triisopropylbenzenetricarboxylate | 170 g |

The polyester resin B had a compound having a molecular weight not greater than $5\times10^2$ in an amount of 3.0%; a molecular weight peak of $8\times10^3$; a glass transition temperature of 62° C.; a ratio (Mw/Mn) of 4.7; an acid value of 0.5 KOH mg/g; and a temperature at which the resin has an apparent viscosity of $10^3$ Pa·s when measured by a flow tester of 116° C. The polyester resin B did not include THF-insoluble components.

Synthesis Example 3

The procedure for preparation of the polyester resin A was repeated except for using the following materials and formulation to prepare a polyester resin C:

| | |
|---|---|
| Polyoxypropylene(2,2)-2,2-bis (4-hydroxyphenyl)propane | 650 g |
| Polyoxyethylene(2,2)-2,2-bis (4-hydroxyphenyl)propane | 650 g |
| Isophthalic acid | 515 g |
| Isooctenyl succinic acid | 70 g |
| 1,2,4-benzenetricarboxylic acid | 80 g |

The polyester resin C had a compound having a molecular weight not greater than $5\times10^2$ in an amount of 2.1%; a molecular weight peak of $8.2\times10^3$; a glass transition temperature of 61° C.; a ratio (Mw/Mn) of 4.6; an acid value of 10.0 KOH mg/g; and a temperature at which the resin has an apparent viscosity of $10^3$ Pa·s when measured by a flow tester of 117° C. The polyester resin C did not include THF-insoluble components.

Synthesis Examples of Additives (I) A treatment agent and properties of hydrophobized silica having a primary particle diameter of from 0.01 to 0.03 μm are shown in Table 1.

TABLE 1

| No. | Treatment agent | Hydrophobicity | Primary particle diameter |
|---|---|---|---|
| I-1 | Polydimethylsiloxane | 80 | 0.02 |
| I-2 | Hexamethyldisilazane | 70 | 0.02 |
| I-3 | Dimethyldichlorosilane | 70 | 0.02 |
| I-4 | Hexamethyldisilazane | 50 | 0.02 |

(II) Synthesis examples of titanium oxides having a primary particle diameter of from 0.01 to 0.03 μm and a specific surface area of from 60 to 140 $m^2/g$, and properties thereof are shown in Table 2.

Synthesis Example a

Three hundred g of titanium oxide MT-150® A prepared by a wet method, including water-soluble components in an amount of 0.35% by weight and having an average particle diameter of 0.015 μm from Tayca Corp. were put in a toluene solution including 35 g of isobutylmethoxysilane dissolved therein, and stirred and dispersed. Then, the dispersed mixture was dried up and pulverized by a jet mill to prepare a titanium oxide treated with a coupling agent (titanium oxide II-1).

Synthesis Example b

The procedures for preparation of the titanium oxide II-1 in Synthesis Example a were repeated to prepare another titanium oxide treated with a coupling agent (titanium oxide II-2) except for using a toluene solution including 25 g of the isobutylmethoxysilane dissolved therein.

Synthesis Example c

The procedures for preparation of the titanium oxide II-1 in Synthesis Example a were repeated to prepare a third titanium oxide treated with a coupling agent (titanium oxide II-3) except for using a toluene solution including 30 g of methyltrimethoxysilane dissolved therein.

Synthesis Example d

The procedures for preparation of the titanium oxide II-1 in Synthesis Example a were repeated to prepare a third titanium oxide treated with a coupling agent (titanium oxide II-4) except for using a toluene solution including 30 g of n-butyltrimethoxysilane dissolved therein.

TABLE 2

| No. | Treatment agent | Primary particle diameter | Specific surface area | 300 nm transmittance | 600 nm transmittance |
|---|---|---|---|---|---|
| II-1 | Isobutyltrimethoxysilane | 0.015 | 90 | 38 | 97 |
| II-2 | Isobutyltrimethoxysilane | 0.015 | 90 | 39 | 95 |
| II-3 | Methyltrimethoxysilane | 0.015 | 100 | 36 | 95 |
| II-4 | N-butyltrimethoxysilane | 0.015 | 100 | 40 | 94 |

Example 1

The following colorants and resins for each color were mixed by a Henschel mixer, and the mixture was kneaded upon application of heat by a waterless two-roll mill for 15 min. Then, the kneaded mixture was extended upon application of pressure and cooled, and crushed by a hammer mill to prepare a colorant treated with the polyester resin A.

| | |
|---|---|
| Yellow colorant: | |
| Polyester resin A | 100 |
| C.I. pigment yellow 180 | 100 |
| Red colorant: | |
| Polyester resin A | 100 |
| C.I. pigment red 122 | 100 |
| Blue colorant: | |
| Polyester resin A | 100 |
| C.I. pigment blue 15.3 | 100 |
| Black colorant: | |
| Polyester resin A | 100 |
| Carbon black | 100 |

Next, the following materials for each color were mixed by a Henschel mixer, and the mixture was kneaded by a roll mill having a temperature of 110° C. for 20 min. The kneaded mixture was cooled and crushed by a hammer mill, and pulverized by an air jet mill pulverizer. Fine powders were further removed from the pulverized mixture by a wind-force classifier to prepare each color toner.

| | |
|---|---|
| Yellow toner: | |
| Polyester resin A | 94 |
| Yellow colorant treated with the polyester resin A | 12 |
| Zinc 3,5-ditertiarybutylsalicylate compound | 3 |
| Magenta toner: | |
| Polyester resin A | 95 |
| Red colorant treated with the polyester resin A | 10 |
| Zinc 3,5-ditertiarybutylsalicylate | 3 |
| Cyan toner: | |
| Polyester resin A | 97 |
| Blue colorant treated with the polyester resin A | 6 |
| Zinc 3,5-ditertiarybutylsalicylate | 3 |
| Black toner: | |
| Polyester resin A | 93 |
| Black colorant treated with the polyester resin A | 12 |
| Blue colorant treated with the polyester resin A | 2 |
| Zinc 3,5-ditertiarybutylsalicylate | 3 |

The following additives were mixed with 100 parts of each color toner by a Henschel mixer to prepare a one-component developer.

| | |
|---|---|
| I-2 hydrophobic silica | 2.5 |
| II-1 hydrophobic titanium oxide | 0.8 |

The one-component developer was set in a marketed digital full-color printer IPSiO Color 6500® from Ricoh Company, Ltd. to produce images. The images were clear and no defect such as background fouling was observed. A developing roller thereof was visually observed to find a thin toner layer thereon was uniform. A charge quantity thereon was measured by a suction method to find that the yellow developer had −38 μMC/g, magenta developer had −35 μC/g, cyan developer had −36 μC/g and that the black developer had −34 μC/g. An image was produced in an environment of high temperature and high humidity (27° C. and 80% RH) and of low temperature and low humidity (10° C. and 15% RH) as well. No change was observed and a good image was produced in both environments. Total 20,000 full-color images were continuously produced in each environment of normal temperature, low temperature and low humidity, high temperature and high humidity and normal temperature to find no significant change in the images and that the 20,000$^{th}$ image was clear without background fouling. The developing roller was visually observed to find no significant change in the thin toner layer thereon, and the yellow developer had a charge quantity of −31 μC/g, magenta developer −28 μC/g, cyan developer −30 μC/g and the black developer −28 μC/g stably. The developing roller, a blade and a photoreceptor of the printer were visually observed to find no toner filming.

Example 2

The following colorants and resins for each color were mixed by a Henschel mixer, and the mixture was kneaded upon application of heat by a waterless two-roll mill for 15 min. Then, the kneaded mixture was extended upon application of pressure and cooled, and crushed by a hammer mill to prepare a colorant treated with the polyester resin A.

| | |
|---|---|
| Yellow colorant: | |
| Polyester resin A | 100 |
| C.I. pigment yellow 180 | 100 |
| Red colorant: | |
| Polyester resin A | 100 |
| C.I. pigment red 146 | 100 |
| Blue colorant: | |
| Polyester resin A | 100 |
| C.I. pigment blue 15.3 | 100 |
| Black colorant: | |
| Polyester resin A | 100 |
| Carbon black | 100 |

Next, the following materials for each color were mixed by a Henschel mixer, and the mixture was kneaded by a biaxial continuous kneader having a temperature of 80° C. for 20 min. The kneaded mixture was cooled and crushed by a hammer mill, and pulverized by an air jet mill pulverizer. Fine powders were further removed from the pulverized mixture by a wind-force classifier to prepare each color toner.

| | |
|---|---|
| Yellow toner: | |
| Polyester resin A | 94 |
| Yellow colorant treated with the polyester resin A | 12 |
| Zinc 3,5-ditertiarybutylsalicylate compound | 3 |
| Magenta toner: | |
| Polyester resin A | 95 |
| Red colorant treated with the polyester resin A | 10 |
| Zinc 3,5-ditertiarybutylsalicylate | 3 |
| Cyan toner: | |
| Polyester resin A | 97 |
| Blue colorant treated with the polyester resin A | 6 |
| Zinc 3,5-ditertiarybutylsalicylate | 3 |
| Black toner: | |
| Polyester resin A | 93 |
| Black colorant treated with the polyester resin A | 12 |
| Blue colorant treated with the polyester resin A | 2 |
| Zinc 3,5-ditertiarybutylsalicylate | 3 |

The following additives were mixed with 100 parts of each color toner by a Henschel mixer to prepare a one-component developer.

| | | |
|---|---|---|
| I-3 | hydrophobic silica | 2.1 |
| II-4 | hydrophobic titanium oxide | 1.0 |

Seven parts of the one-component developer and 93 parts of ferrite carrier coated with a silicone resin were mixed to prepare a two-component developer. The two-component developer was set in a marketed digital full-color printer IPSiO Color 7100® from Ricoh Company, Ltd. to produce images. The images were clear and no defect such as background fouling was observed. Both images produced and charge quantity of the developer in an environment of high temperature and high humidity and an environment of low temperature and low humidity were not abnormal. No abnormal image was produced even when 20,000 full-color images were continuously produced, and no toner scattering and no toner adherence to a photoreceptor in the printer was observed.

Comparative Example 1

Titanium oxide MT-150A® prepared by a wet method, including water-soluble components in an amount of 0.35% by weight from Tayca Corp. was washed with water to prepare a titanium oxide including water-soluble components in an amount of 0.15% by weight. Three hundred g of the titanium oxide were put in a toluene solution including 35 g of isobutylmethoxysilane dissolved therein, and dispersed. Then, the dispersed mixture was dried up and pulverized by a jet mill, and further dispersed by a pin mill to prepare a titanium oxide treated with a coupling agent (titanium oxide II-5). The titanium oxide had a light absorbance of 21% for light having a wavelength of 300 nm and a light absorbance of 97% for light having a wavelength of 600 nm.

Next, the following additives were mixed with 100 parts of each color toner prepared in Example 1 to prepare a one-component developer.

| | | |
|---|---|---|
| I-2 | hydrophobic silica | 2.4 |
| II-5 | hydrophobic titanium oxide | 0.6 |

The one-component developer was set in a marketed digital full-color printer IPSiO Color 6500 from Ricoh Company, Ltd. to produce images. The images had no defect such as background fouling although having a low image density. A developing roller thereof was visually observed to find a thin toner layer thereon was uniform, but had a low developer amount as a whole. A charge quantity thereon was measured by a suction method to find that the yellow developer had −48 μC/g, magenta developer had −40 μC/g, cyan developer had −42 μC/g and that the black developer had −44 μC/g. An image produced in an environment of high temperature and high humidity (27° C. and 80% RH) had a surface roughness. An image produced in an environment of low temperature and low humidity (10° C. and 15% RH) had a lower image density. Total 20,000 full-color images were continuously produced in each environment of normal temperature, low temperature and low humidity, high temperature and high humidity and normal temperature to find abnormal images such as background fouling, toner scattering and stripe images. The developing roller was visually observed to find a stripe in a circumferential direction thereof on the thin toner layer thereon. The yellow developer had a charge quantity of −23 μC/g, magenta developer −20 μC/g, cyan developer −20 μC/g and the black developer −19 μC/g stably, which were all deteriorated.

Comparative Example 2

Synthesis Example (of Binder Resin) 4

The procedures for preparation of the binder rein in Synthesis Example 1 were repeated except for changing feeding amount of the materials to prepare a polyester resin D having a compound having a molecular weight not greater than $5\times10^2$ in an amount of 2.5%; a molecular weight peak of $2.5\times10^4$; a glass transition temperature of 69° C.; a ratio (Mw/Mn) of 12.5; an acid value of 13.2 KOH mg/g; and a temperature at which the resin has an apparent viscosity of 103 Pa·s when measured by a flow tester of 128° C.

The following colorants and resins for each color were mixed by a Henschel mixer, and the mixture was kneaded upon application of heat by a waterless two-roll mill for 15 min. Then, the kneaded mixture was extended upon application of pressure and cooled, and crushed by a hammer mill to prepare a colorant treated with the polyester resin D.

| | |
|---|---|
| Yellow colorant: | |
| Polyester resin D | 100 |
| C.I. pigment yellow 180 | 100 |
| Red colorant: | |
| Polyester resin D | 100 |
| C.I. pigment red 146 | 100 |
| Blue colorant: | |
| Polyester resin D | 100 |
| C.I. pigment blue 15.3 | 100 |
| Black colorant: | |
| Polyester resin D | 100 |
| Carbon black | 100 |

Next, the following materials for each color were mixed by a Henschel mixer, and the mixture was kneaded upon application of heat by a biaxial continuous kneader having a temperature of 90° C. The kneaded mixture was cooled and crushed by a hammer mill, and pulverized by an air jet mill pulverizer. Fine powders were further removed from the pulverized mixture by a wind-force classifier to prepare each color toner.

| | |
|---|---|
| Yellow toner: | |
| Polyester resin D | 94 |
| Yellow colorant treated with the polyester resin D | 12 |
| Zinc 3,5-ditertiarybutylsalicylate compound | 3 |
| Magenta toner: | |
| Polyester resin D | 95 |
| Red colorant treated with the polyester resin D | 10 |
| Zinc 3,5-ditertiarybutylsalicylate | 3 |
| Cyan toner: | |
| Polyester resin D | 97 |
| Blue colorant treated with the polyester resin D | 6 |
| Zinc 3,5-ditertiarybutylsalicylate | 3 |
| Black toner: | |
| Polyester resin D | 93 |
| Black colorant treated with the polyester resin D | 12 |

-continued

| | |
|---|---|
| Blue colorant treated with the polyester resin D | 2 |
| Zinc 3,5-ditertiarybutylsalicylate | 3 |

The following additives were mixed with 100 parts of each color toner by a Henschel mixer to prepare a one-component developer.

| | | |
|---|---|---|
| I-2 | hydrophobic silica | 2.5 |
| II-1 | hydrophobic titanium oxide | 0.8 |

The one-component developer was set in a marketed digital full-color printer IPSIO Color 6500® from Ricoh Company, Ltd. to produce images. The images had a touch of background fouling and had no gloss. A developing roller thereof was visually observed to find a thin toner layer thereon was uniform. A charge quantity thereon was measured by a suction method to find that the yellow developer had −23 μC/g, magenta developer had −20 μC/g, cyan developer had −21 μC/g and that the black developer had −19 μC/g. An image produced in an environment of high temperature and high humidity (27° C. and 80% RH) had worse background fouling. Total 20,000 full-color images were continuously produced in each environment of normal temperature, low temperature and low humidity, high temperature and high humidity and normal temperature to find that the background fouling and toner scattering became worse when 10,000 images were produced. The developing roller was visually observed to find a number of stripes in a circumferential direction thereof on the thin toner layer thereon.

This document claims priority and contains subject matter related to Japanese Patent Application No. 2003-149849 filed on May 27, 2003 incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

(A) a binder resin;

(B) a colorant;

(C) a charge controlling agent; and (D) an additive;

wherein said binder resin (A) comprises:

a polyester resin containing no tetrahydrofuran-insoluble component; and having a molecular weight distribution wherein components having a molecular weight not greater than $5\times10^2$ are present in an amount of 4% or less by weight, and wherein a main peak is present in a molecular weight range of from $3\times10^3$ to $9\times10^3$ when the molecular weight distribution is determined by gel permeation chromatography;

wherein said charge controlling agent (C) comprises:

a metal salt of salicylic acid or salicylic acid derivative; and wherein said additive (D) comprises:

a hydrophobized silica having a primary particle diameter of from 0.01 to 0.03 μm; and a hydrophobized titanium oxide having a primary particle diameter of from 0.01 to 0.03 μm and a specific surface area of from 60 to 140 $m^2/g$, wherein the hydrophobized titanium oxide is prepared by surface-treating a particulate titanium oxide prepared by a wet process, wherein said hydrophobized titanium dioxide comprises one or more water-soluble components in an amount of 0.2% or more by weight, and has a transmittance not less than 35% for light having a wavelength of 300 nm and a transmittance not less than 80% for light having a wavelength of 600 nm.

2. The toner of claim 1, wherein the binder resin (A) has an endothermic peak in a temperature range of from 60 to 70° C. as determined by differential scanning calorimetry (DSC).

3. The toner of claim 1, wherein the binder resin (A) has a weight-average molecular weight (Mw) and a number-average molecular weight (Mn) satisfying the following relationship:

$$2 \leqq Mw/Mn \leqq 10.$$

4. The toner of claim 1, wherein the binder resin (A) has an acid value not greater than 10 KOH mg/g.

5. The toner of claim 4, wherein the binder resin (A) has an acid value not greater than 5 KOH mg/g.

6. The toner of claim 1, wherein the binder resin (A) has an apparent viscosity of $10^4$ Pa·S at a temperature of from 95 to 120° C. when the viscosity is determined by a flow tester.

7. The toner of claim 1, wherein the charge controlling agent (C) is present in the toner in an amount of from 0.1 to 10% by weight.

8. The toner of claim 1, wherein the hydrophobized silica is present in an amount not less than 2.1 parts by weight and the hydrophobized titanium oxide is present in an amount of from 0.4 to 1.0 parts by weight, per 100 parts by weight of total of the binder resin (A), colorant (B) and charge controlling agent (C).

9. The toner of claim 1, wherein the charge controlling agent (C) is a salicylic acid or a metal salt compound of a salicylic acid derivative having the following formula (1):

(1)

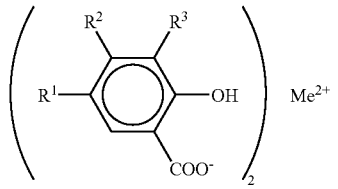

wherein $R^1$, $R^2$ and $R^3$ each, independently, represent a hydrogen atom, an alkyl group having 1 to 10 carbon atoms or an allyl group; and Me represents a metal selected from the group consisting of Zn, Ni, Co, Pb and Cr.

10. The toner of claim 9, wherein $R^1$, $R^2$ and $R^3$ each, independently, represent a hydrogen atom, an alkyl group having 1 to 6 carbon atoms or an allyl group.

11. The toner of claim 9, wherein Me represents Zn.

12. A one-component developer comprising the toner according to claim 1.

13. A two-component developer comprising the toner according to claim 1 and a carrier.

14. An image forming method comprising:

forming a latent image on a latent image bearer;

developing the latent image with a developer comprising a toner, to form a toner image;

transferring the toner image onto a transfer material; and fixing the toner image on the transfer material upon application of heat, wherein the toner is the toner according to claim 1.

15. The image forming method of claim 14, wherein, in the toner, the binder resin (A) has an endothermic peak in a temperature range of from 60 to 70° C. as determined by differential scanning calorimetry (DSC).

16. The image forming method of claim 14, wherein, in the toner, the binder resin (A) has a weight-average molecular weight (Mw) and a number-average molecular weight (Mn) satisfying the following relationship:

$$2 \leqq Mw/Mn \leqq 10.$$

17. The image forming method of claim 14, wherein, in the toner, the binder resin (A) has an acid value not greater than 10 KOH mg/g.

18. The image forming method of claim 14, wherein, in the toner, the binder resin (A) has an apparent viscosity of $10^4$ Pa·S at a temperature of from 95 to 120° C. when the viscosity is determined by a flow tester.

19. The image forming method of claim 14, wherein, in the toner, the charge controlling agent (C) is present in the toner in an amount of from 0.1 to 10% by weight.

20. The image forming method of claim 14, wherein, in the toner, the hydrophobized silica is present in an amount not less than 2.1 parts by weight and the hydrophobized titanium oxide is present in an amount of from 0.4 to 1.0 parts by weight, per 100 parts by weight of total of the binder resin (A), colorant (B) and charge controlling agent (C).

21. The image forming method of claim 14, wherein, in the toner, the charge controlling agent (C) is a salicylic acid or a metal salt compound of a salicylic acid derivative having the following formula (1):

(1)

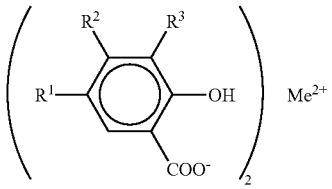

wherein $R^1$, $R^2$ and $R^3$ each, independently, represent a hydrogen atom, an alkyl group having 1 to 10 carbon atoms or an allyl group; and Me represents a metal selected from the group consisting of Zn, Ni, Co, Pb and Cr.

22. The image forming method of claim 21, wherein $R^1$, $R^2$ and $R^3$ each, independently, represent a hydrogen atom, an alkyl group having 1 to 6 carbon atoms or an allyl group.

23. The image forming method of claim 21, wherein Me represents Zn.

* * * * *